United States Patent [19]

Brach et al.

[11] Patent Number: 4,572,412

[45] Date of Patent: Feb. 25, 1986

[54] CONTAINER MADE OF PLASTIC WHICH CAN BE ELASTICALLY DEFORMED

[75] Inventors: Ulrich Brach, Zell, Fed. Rep. of Germany; Wilhelm Wiesinger, Zurich, Switzerland

[73] Assignee: Zeller Plastik Koehn, Graebner & Co., Zell, Fed. Rep. of Germany

[21] Appl. No.: 638,727

[22] Filed: Aug. 8, 1984

[30] Foreign Application Priority Data

Aug. 9, 1983 [DE] Fed. Rep. of Germany ..... 3328630
Dec. 1, 1983 [DE] Fed. Rep. of Germany ..... 3343460

[51] Int. Cl.[4] ..... B65D 5/72

[52] U.S. Cl. ..... 222/527; 222/572; 222/574; 215/1 C

[58] Field of Search ..... 215/1 C; 222/574, 527, 222/572, 529; 428/35

[56] References Cited

U.S. PATENT DOCUMENTS

| | | | |
|---|---|---|---|
| 3,185,353 | 5/1965 | Mercier | 215/1 C |
| 4,243,162 | 1/1981 | Klygis | 215/1 C |
| 4,401,241 | 8/1983 | Cruz | 222/527 |

*Primary Examiner*—John E. Kittle
*Assistant Examiner*—James J. Seidleck
*Attorney, Agent, or Firm*—Gilbert L. Wells

[57] ABSTRACT

A container, in particular a bottle, made of a plastic which can be elastically deformed. The container has a pipe for filling and removing the contents. The container has a part which can be folded in in its main part or in its shoulder section. The pipe can be brought into an inclined position relative to the axis of the container by a folding-in operation, by which the container contents can be emptied or poured out at an angle while the container is held vertical but upside down.

12 Claims, 16 Drawing Figures

FIG. 7
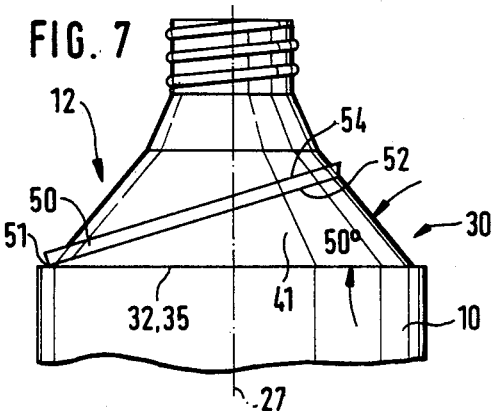
FIG. 10
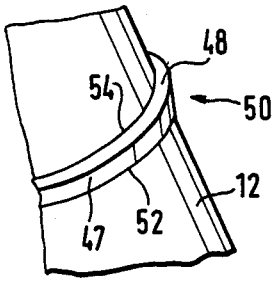
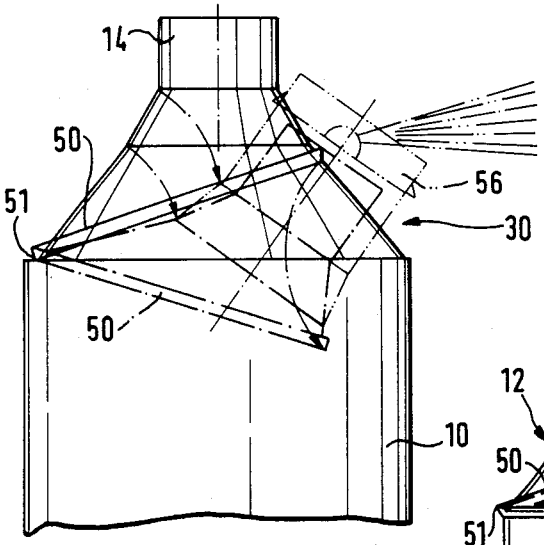
FIG. 8
FIG. 9
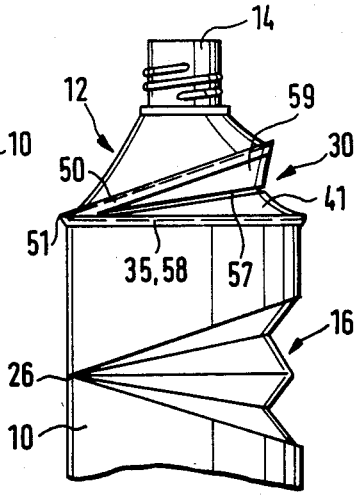

CONTAINER MADE OF PLASTIC WHICH CAN BE ELASTICALLY DEFORMED

STATE OF THE ART, OBJECT, SOLUTION

The invention relates to a container, in particular a bottle made of plastic which can be elastically deformed, the container having a pipe for filling and removing the contents.

Bottle-like containers for powdery cleaning agents with a rigid, integrally moulded, inclined pipe for emptying the cleaning agent are known and can be obtained on the market. This inclined position is expedient for certain applications. For example, cleaning agent can be poured on the inside walls of containers which are difficult of access from above because of an inwardly overlapping edge. Toilet bowls are an example of this.

Such containers require specially adapted devices for filling the contents and specially adapted devices for sealing the pipe. Consequently, filling and sealing are expensive.

It is an object of the invention to enable the pipe to be brought from a normal position, in which it runs parallel to the axis, into an inclined position.

In this way, for example, petrol cans can also be produced so that their pipe can be brought into an inclined position and can consequently be easily inserted in the filler neck of a motor vehicle petrol tank without the petrol being spilled. The same applies to containers for engine oil.

The pipe is to assume a stable position relative to the container in both the normal position and the inclined position. Tilting it from one position to the other should therefore only be possible by exerting a certain amount of force.

This object is achieved with a container, in particular a bottle, made of a plastic which can be elastically deformed, with a filler and emptying pipe, characterized in that at least one part, which can be folded in, of the container wall has predetermined or nominal bending lines in the form of line-like or strip-like weakened areas, at which the container wall can be bent or folded in such a way that the pipe can be tilted relative to a portion of the container from a stable normal position into a stable inclined position and vice versa.

Accordingling, predetermined or nominal bending lines (herein after simply called "nominal bending lines") are provided on the wall of the container, which enable a part of the container, namely that part which carries the pipe, to be folded relative to the rest of the container.

This enables the required stable, inclined position of the pipe to be achieved, and consequently the contents can be poured out obliquely sideways when the container is placed on its head. It is especially not necessary for this purpose to screw on or connect an additional part to the container opening. For example, the standard screw-on filler pipes for petrol cans are dispensed with.

According to the invention, it is possible to fill the container when its pipe is in the normal position, and to empty it when the pipe is in the inclined position. Therefore standard filling machines and the standard heads of closing or sealing machines can be used.

FURTHER DEVELOPMENTS OF THE INVENTION

According to another embodiment, the part which can be folded in may be bounded by nominal bending lines, which when viewed in the direction of the folding axis, diverge from one side of the container toward the other. At least one inclined surface may be located between the planes, that is, a wall surface of the container running at an angle to the axis. By this is meant that the surface widens or narrows in the axial direction of the container. Such inclined surfaces can be inverted by a folding process. Because they are wider on one side of the container than on the other, the container is shortened on one side by the inversion process, that is, it is folded.

According to still another embodiment, more than one inclined surface can be provided, an inclined surface narrowing in the axial direction of the container being followed by a widening inclined surface, which process can be continued. This enables the container to be folded through a considerable angle. This arrangement is mainly of advantage if the part of the container which can be folded in is to have an essentially uniform cross-section at its main part.

According to a further embodiment, the part which can be folded in can be arranged at the shoulder section of the container, this shoulder section being, for example on a bottle, conical or narrowing in a convex or concave manner toward the pipe. By the arrangement of at least two nominal bending lines, the shoulder section can be designed to be foldable.

Various containers have a rectangular cross-section or at least a shoulder section with a rectangular cross-section. For such containers, according to yet another embodiment, the part which can be folded in can be designed in the nature of a hipped roof, the pipe being attached to one of the (trapezoidal) main surfaces of the hipped roof.

According to still another embodiment, a seal can be created for the container contents for the inside end of the pipe. This pipe end can be pushed, for example, over a stopper which protrudes inwards from one wall of the container.

According to still a further embodiment, the nominal bending lines can be formed as channels which are either open to the inside or outside. Both types of embodiment are suitable for the manufacture of containers by a blowing or vacuum forming process. Instead, the nominal bending lines can be designed in a way known per se as film hinges, which is suitable for manufacture by injection moulding.

According to further embodiments, the nominal bending lines can have at least a narrow surface strip which provides for a prominent necking of the container. This enables the container wall surfaces adjacent to the nominal bending line to maintain their original shape when the container is folded in, for example they can remain cylindrical or conical. This prevents them from bulging outwards or inwards during the folding operation.

Illustrative embodiments with further features of the invention are described in the following with the aid of the drawings.

FIG. 7 is the side view of the upper part of a bottle with a foldable shoulder section of another form in the basic position.

FIG. 8 is a partial side view of the same bottle in the basic position and the folded position.

FIG. 9 is the side view of the upper part of a bottle which has a part which can be folded in at both its cylindrical main part and at its shoulder section.

FIG. 10 is a persective view of a detail of the bottles according to FIGS. 7, 8 and 9.

FIRST TYPE OF EMBODIMENT

Figure 1:
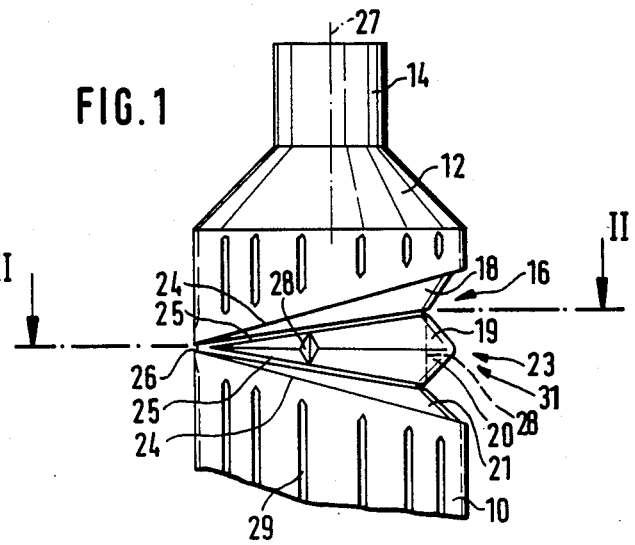
FIG. 1 is a partial side view of a bottle with a main part which can be folded.
Figure 2:
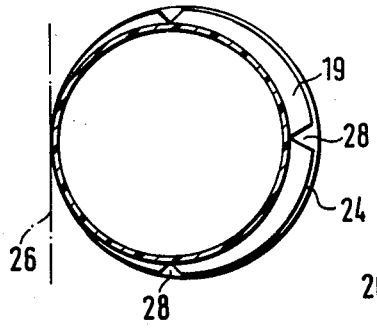
FIG. 2 is a section through this bottle along a line II—II in FIG. 1.
Figure 3:
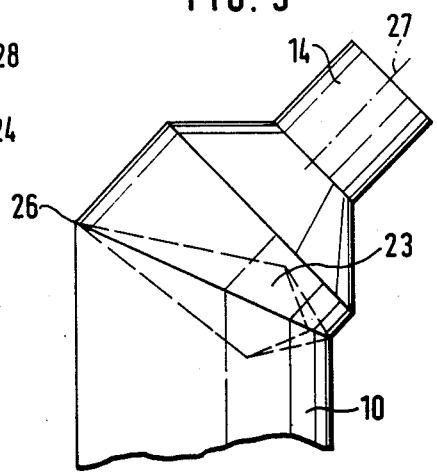
FIG. 3 is a partial side view of this bottle in the folded position.

FIGS. 1 to 3 show a container, in particular a bottle made of a material which can be elastically deformed, preferably a plastic in the nature of one of the polyolefines. The main part 10 of the container or bottle has a circular cross-section. However, the section can be oval polygonal or of another form. The upper end of the main part merges via a shoulder section 12 narrowing upwards with a pipe 14 provided for filling and dispensing (pouring out).

The main part has a part 16 which can be folded in, by which the bottle can be brought into a position according to FIG. 3. The part 16 of the bottle which can be folded in is formed by four inclined surfaces 18 to 21. Viewed from top to bottom, an inclined surface 18 narrowing downwards is followed by an inclined surface 19 widening downwards, followed by a narrowing inclined surface 20 and finally a widening inclined surface 21. Viewed in the direction of the axis 27 of the container, the inclined surfaces have a crescent shape, as shown in FIG. 2 for the inclined surface 19.

The inclined surfaces 19 and 20 together form a rigid hollow part 23. This is bounded at the top and bottom by a nominal bending line 25 in the form of a channel open to the outside. (Instead of this, channels open to the inside can also be used.) This type of bending line is especially suitable for bottles manufactured by a blowing or vacuum forming process. During the blowing process, the material is thinly drawn out in the mould over an appropriate rib (or drawn into or blown into a groove provided in the mould). This later permits a faultless bending or folding operation.

The two outer inclined surfaces 18 and 21 merge with the main part 10 at nominal bending lines 24. These bending lines are formed by narrow surface strips, which here have the form of a very narrow crescent moon (FIG. 2) and lie in the inclined planes of the bending lines 24.

The inclined surfaces 18 to 21 have the form of crescent moons, as shown by FIG. 2 for the inclined surface 19.

The hollow part 23 can be reinforced, for example by reinforcing ribs 28 which point inwards and are preferably arranged as shown in FIG. 2. But more reinforcing ribs can be provided. The main part 10 of the bottle can have reinforcing ribs 29 above and below its part 16 which can be folded in.

The nominal bending lines 24 and 25 approach one another at the left-hand side of the bottle at a fold axis 26, whose position is shown by FIGS. 1 and 2.

If the upper part of the bottle is folded relative to the lower part, the bottle comes into the position according to FIG. 3. The rigid hollow part 23 remains unaltered, but presses partly into the upper and partly into the lower part of the bottle while inverting the inclined surfaces 18 and 21. The inclined surfaces 18 and 21 are inverted from their stable position according to FIG. 1 into another stable position according to FIG. 3 so that the bottle maintains unaltered the position it reaches after every folding operation.

The part which can be folded in can also have another design, for example designed so that not a rigid hollow part 23 is formed but, for example, the inclined surface 18 is rigidly designed and the inclined surface 19 can be inverted, the inclined surface 20 in turn rigid and the inclined surface 21 can be inverted. Reinforcing ribs will then be arranged as appropriate only within the rigid inclined surfaces.

The part 16 which can be folded in can also have, instead of the four inclined surfaces, only two inclined surfaces, one of which remains rigid during the folding operation while the other is inverted.

In all of these cases a fold position results in which the inclined surfaces located on the inside are no longer visible. This leads to an aesthetically satisfying impression.

Because the nominal bending lines 24 have narrow surface strips in their inclined planes, a prominent necking results. This prevents the side wall of the main part 10 from bulging out when folding into the position according to FIG. 3. On the contrary, the side walls remain perfectly cylindrical even in the folded position.

SECOND TYPE OF EMBODIMENT

Parts with the same function as in the first type of embodiment are provided with the same reference numbers in the second and following types of embodiment, even if they deviate in their outer form. The above description also applies to these parts.

Figure 4:
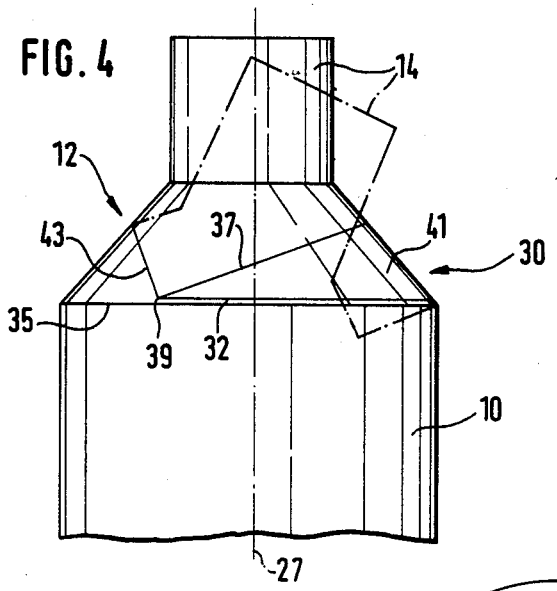
FIG. 4 is a longitudinal section through the upper part of a bottle with a shoulder section which can be folded.
Figure 5:
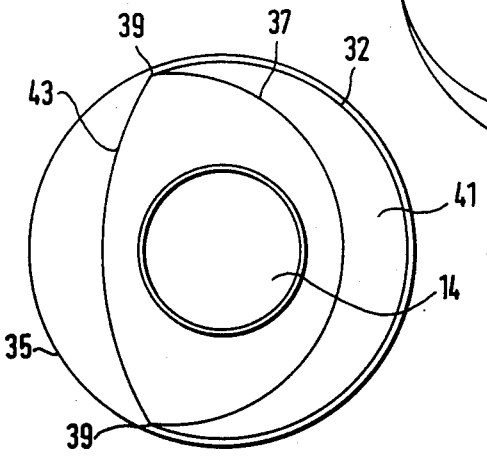
FIG. 5 is a plan view of this bottle.

FIGS. 4 and 5 show the upper part of a container, in particular a bottle made of a material of the above type which can be elastically deformed. The bottle again has a main part 10, a shoulder section 12 which is, for example, conical in shape and a pipe 14. Instead of being conical, the shoulder section 12 could also bulge inwards or outwards. It can, for example, merge with the pipe 14 to form a bell shape.

The shoulder section 12 has a nominal bending line 32, which extends about two-thirds around the circumference and lies in a plane at right angles to the axis 27 of the container. This nominal bending line can be arranged, as shown, closely above the base line 35 of the shoulder section, but also further above, or it can coincide with the base line. In an imaginary plane, which is inclined towards the axis 27, another nominal bending line 37 is arranged. Because this cuts the conical surface of the shoulder section 12 at an angle, it is part of an ellipse. The two nominal bending lines 32 and 37 touch at the corner points 39, so that in the plan view a crescent-shaped inclined surface 41 is formed between the two bending lines 32 and 37. The two corner points 39 are connected by another nominal bending line 43. This nominal bending line has a shallow curvature when viewed from above (FIG. 5). Viewed from the side, that is from the left in FIG. 4, it has a substantially deeper curvature.

The inclined surface 41 can be inverted downwards, by means of which the pipe 14 can assume an inclined position shown as a broken line in FIG. 4. Again, both end positions of the pipe are stable. As with the first type of embodiment, the coaxial basic position of the pipe is essential for manufacturing and filling the bottle. The inclined position is essential for removing the contents, possibly also for transporting on account of the space saving which can be achieved by this.

The arrangement can be made so that the axis of the pipe 14 in its folded position forms a substantially greater angle with the bottle axis 27, as shown in FIG. 4.

Figure 6:
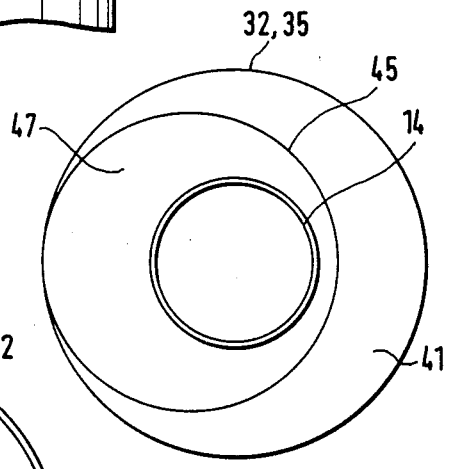
FIG. 6 is a plan view of a bottle with a shoulder section which can be folded, but with nominal bending lines of another form.

FIG. 6 shows a modified type of embodiment. Here, the two corner points 39 between nominal bending lines are dispensed with. The nominal bending lines 37 and 43 according to FIGS. 4 and 5 are replaced in the type of embodiment according to FIG. 6 by a self-contained nominal bending line 45, which in plan view according to FIG. 6 has a circular shape. This nominal bending line 45 is tangent to the circular nominal bending line 32, which here coincides with the circular base line 35 of the shoulder section of the bottle (although this is not absolutely necessary). The nominal bending line 45 lies in an inclined plane. The crescent-shaped inclined surface 41 here describes a greater arc than in the type of embodiment according to FIG. 5 and is approximately self-contained. The folded position which can be achieved with this type of embodiment is very similar to that according to FIG. 4. The inclined surface 41 can be turned inwards from the position shown. A conical ring surface 47, which is located between the pipe 14 and the nominal bending line 45, retains its conical shape when being folded over.

THIRD TYPE OF EMBODIMENT

In the type of embodiment according to FIGS. 7 and 8, the shoulder section 12 has a conical shape. The side walls are inclined by about 50° toward the plane of the base line 35. Here, the base line 35 functions as a nominal bending line 32. Only a second nominal bending line 50 is provided, which is arranged in a plane inclined toward the axis 27. This nominal bending line 50 can be designed as a channel, open to the inside or outside, of any cross-sectional shape. FIG. 10 shows a special form. Here, the nominal bending line 50 has two surfaces, namely a very narrow, inclined ring surface 47 widening upwards in the nature of a truncated cone, and a very narrow ring surface 48 lying in a plane inclined to the axis 27. The inclined ring surface 47 merges at a lower boundary line 52, and the flat ring surface 48 merges at an upper boundary line 54 with the inclined surface 41 which in this case is conical.

FIG. 8 shows which paths of motion are traced by individual well-defined points of the shoulder section during the transition from the basic position into the folded position. The upper part of the shoulder section with the pipe 14 tilts about a folding axis 51, which runs tranversely to the plane of the drawing.

Moreover, FIG. 8 shows that a spraying head 56 (drawn in broken lines) can be screwed onto the pipe. With simple dies it is only possible to manufacture spraying heads whose main spraying direction is considerably less than 90° relative to the container axis. By folding-in the container, a main spraying direction at right angles to the container axis can be achieved here by using a spraying head which can be easily manufactured.

The nominal bending line 32 at the lower end of the inclined surface 41 also has a narrow, flat ring surface in a plane at right angles to the axis 27. This nominal bending line 32 therefore forms a prominent necking, which, as described above, ensures that the adjacent walls keep their shape after the folding operation, that is, the main part 10 keeps its cylindrical shape and the shoulder section 12 its conical shape.

FOURTH TYPE OF EMBODIMENT

As shown in FIG. 9, parts which can be folded in at the main part 10 of the bottle and at the shoulder section 12 can be combined so that both can be folded in the same direction. This enables the pipe 14 to be brought into a position in which its axis forms approximately a right angle with the axis of the bottle.

FIG. 9 also shows that a nominal bending line 58 along the base line 35 can be designed in the nature of the nominal bending line 50 in FIGS. 7 and 10. The part 30 which can be folded in has two inclined surfaces 41 and 59, between which is located a nominal bending line 57 in the form of a channel open to the outside. When the part 30 is folded in, the inclined surface 59 remains unaltered, whereas the inclined surface 41 is inverted downwardly. The nominal bending lines 50 and 58 then lie on top of one another, so that no hollow is visible, as in FIG. 8. The shoulder section 12 which is then in an inclined position appears to sit directly on the main part 10 of the container.

FIFTH TYPE OF EMBODIMENT

Figure 11:
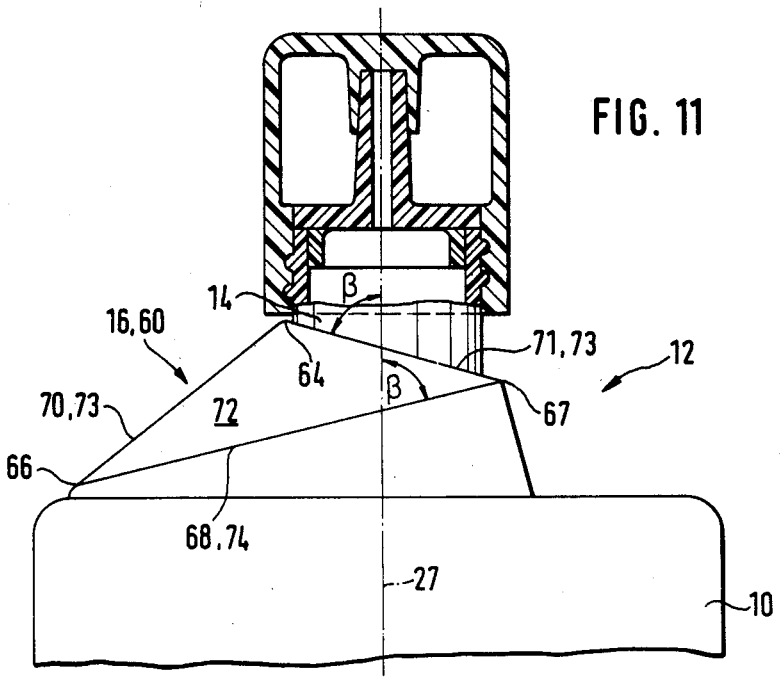
FIGS. 11 and 12 are partial side views of a container which carries a filler and emptying pipe at an invertable roof surface.
Figure 12:
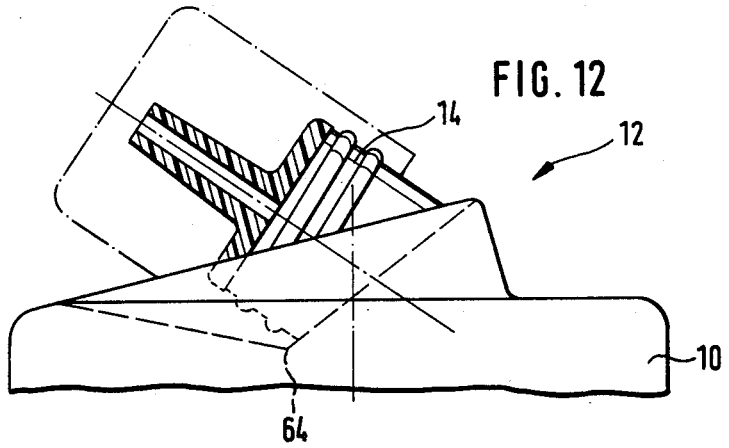
Figure 13:
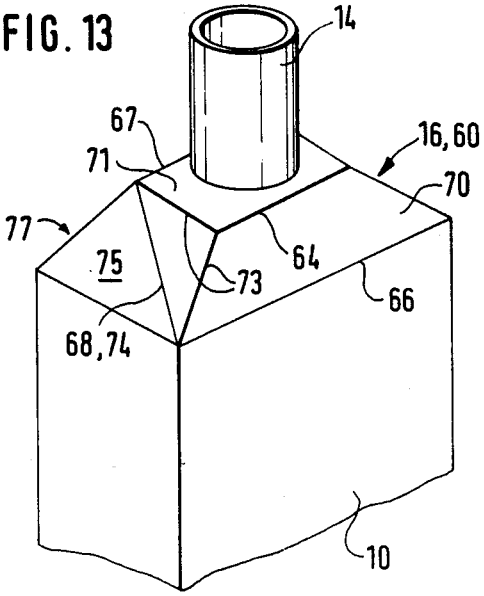
FIGS. 13 and 14 are perspective views of the upper part of a container of this nature with a modified arrangement of the roof surface.
Figure 14:
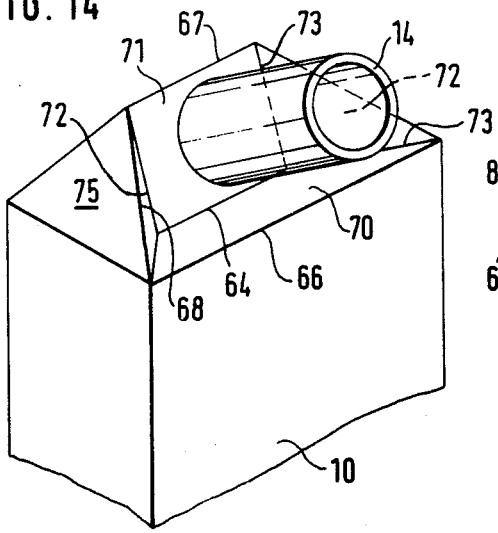

FIGS. 11 to 16 show a container, for example a petrol can, a washing agent container or even a bottle with a rectangular cross-section. This part of the invention can also be applied to containers which have only a shoulder section of rectangular cross-section and any shape below that. The part 16 which can be folded in has here the shape of a roof surface 60 in the special shape of a hipped roof. The ridge of the hipped roof is formed by a nominal bending line 64. The eaves running around the roof are formed by nominal bending lines 66, 67 and 68. Between the nominal bending lines are located two trapezoidal main roof surfaces 70 and 71, of which only the side edges can be discerned in FIGS. 11 and 12, and triangular side roof surfaces 72, of which only the front one can be discerned. The perspective views in FIGS. 13 and 14 show (for another type of embodiment) the roof surfaces more clearly.

The pipe 14 sits on the right-hand main roof surface 71 (FIGS. 11 and 12), the pipe axis forming an acute angle $\beta$ with this main roof surface 71. The nominal bending lines 66, 67 and 68 lie in a common, imaginary plane 74, which in the position according to FIG. 11 also forms an angle $\beta$ with the axis of the container. The main roof surface 71 and the plane 74 are inclined in opposite directions. This arrangement enables the pipe axis to run in line with the axis 27 of the container or to run parallel to it. The part of the shoulder section 12 beneath the plane 74 is essentially rigid, in any case it is not designed to be invertable. If the pipe 14 is tilted into the position according to FIG. 12, the roof surface is inverted as shown in broken lines in FIG. 12. Both final positions of the roof surface are stable.

SIXTH TYPE OF EMBODIMENT

In the type of embodiment according to FIGS. 13 and 14, the imaginary plane 74, that is, the base surface of the roof, is arranged at an essentially greater inclination than according to FIGS. 11 and 12. The individual roof surfaces and their bending lines have the same reference numbers as in FIGS. 11 and 12 which clearly shows the relationships with the aid of the pertinent description. The upper main roof surface 71 is here horizontal, that is, at right angles to the container axis. The front, main roof surface 70 in FIG. 13 is preferably inclined at the same angle relative to the vertical as a corresponding rear container wall 77. A symmetrical appearance results despite the steeply inclined roof surface.

When the roof surface is folded in, the nominal bending lines 66, 67 and 68 of the eaves remain in their position, whereas the nominal bending line 64 of the ridge moves inwards, so that all roof surfaces then run inwards toward this nominal bending line 64 and the pipe 14 is in an inclined position. In FIG. 14 one looks into the turned-in roof surface.

The nominal bending lines could also be arranged in the reversed order so that the pipe is in an inclined position when the roof surface is turned out and, on the other hand, runs parallel to the container axis when the roof surface is turned in.

SEVENTH TYPE OF EMBODIMENT

Figure 15:
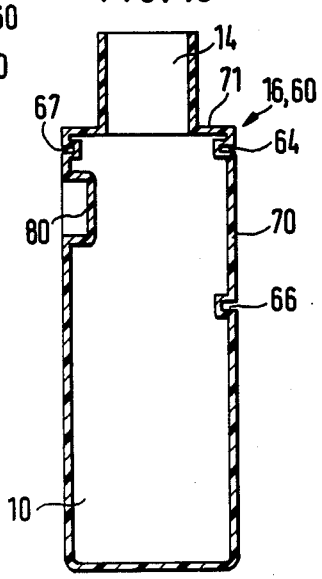
FIGS. 15 and 16 are longitudinal sections of a similar container with an internal sealing for the pipe.
Figure 16:
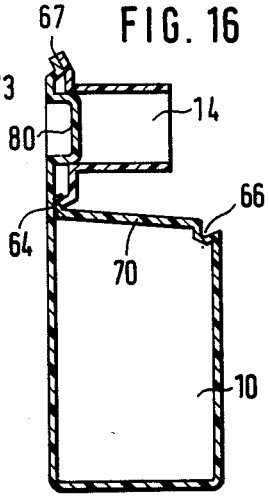

FIGS. 15 and 16 show in a vertical longitudinal section a similar type of embodiment of a container as FIGS. 13 and 14. However, here the pipe 14 can be tilted through 90°. A stopper 80 protruding inwards is provided in one container wall. If the pipe 14 with its main roof surface 71 is turned about the nominal bending line 67 when being turned in, its inner opening comes over the stopper 80, by which means the container is sealed to the outside. The positions of the remaining parts, in particular the roof surfaces and the nominal bending lines, again follow from the reference numbers and the preceding description. This type of stopper seal can also be applied if the pipe 14 is only to be folded in through an angle of less than 90°. The stopper 80 then sits at a wall part running inwardly downwards.

GENERAL

FIGS. 15 and 16 show the nominal bending lines as channels open to the outside. Instead of this, channels open to the inside could be used. FIG. 10 shows a possible type of embodiment for the nominal bending line 50. Channels open to the inside or outside are suitable for the blowing of containers. In principle, all of the nominal bending lines shown can be designed as channels.

On the other hand, if the containers are manufactured by injection moulding, for example from polypropylene, the nominal bending lines can be designed as film hinges. In manufacture by injection moulding, the container base can be made as a separate part and screwed on, knocked on or in, or on the other hand welded on.

We claim:

1. Container, in particular a bottle, made of a plastic which can be elastically deformed, with a filler and emptying pipe, characterized in that at least one part, which can be folded in, of the container wall has predetermined or nominal bending lines in the form of line-like or strip-like weakened areas, at which the container wall can be bent or folded in such a way that the pipe can be tilted relative to a portion of the container from a stable normal position into a stable inclined position and vice versa, and (a) the part which can be folded in is bounded by nominal bending lines, which when viewed in the direction of the folding axis, diverge from one side of the container toward the other; and (b) between the nominal bending lines is located at least one wall surface inclined to the axis of the container, this wall surface widening from one side of the container toward the other.

2. Container according to claim 1, characterised in that it has the following features:

(a) along the path of the axis of the container, a narrowing inclined surface is followed by a widening inclined surface;

(b) at least one of these inclined surfaces is bounded by nominal bending lines and can be inverted from one stable end position into a second stable end position.

3. Container according to claim 2, characterised in that the two outer surfaces of four inclined surfaces can be inverted, and the two inner surfaces form a rigid hollow part.

4. Container according to claim 3, characterised in that the hollow part has reinforcing ribs.

5. Container according to claim 1, characterised in that it has the following features:

(a) the container has a shoulder section narrowing towards the pipe;

(b) at or near the wide end of the shoulder section is provided an arc-like, in particular self-contained nominal bending line, which lies at least approximately in a plane at right angles to the axis;

(c) moreover, within the shoulder section is provided at least one arc-like, in the limiting case self-contained nominal bending line, which when viewed in the direction of the folding axis, is inclined to the axis of the container.

6. Container according to claim 5, characterised in that it has the following features:

(a) three arc-like nominal bending lines, touching at their ends, are inclined to the container axis at various angles when viewed in the direction of the folding axis;

(b) one of the nominal bending lines runs around the container axis at the side opposite the others.

7. Container according to claim 5, characterised in that the two self-contained nominal bending lines are present, one of which lies inside the other. (FIG. 6)

8. Container according to claim 1, characterised in that it has the following features:

(a) the container has, at least in the region of its opening, a rectangular cross-section;

(b) the part which can be folded in has the shape of a roof surface in the nature of a hipped roof:

(c) the part which can be folded in has nominal bending lines which border the roof surface, and other nominal bending lines which divide the roof surface into individual surfaces (main surfaces and side surfaces);

(d) the pipe sits on one of the main roof surfaces.

9. Container according to claim 8, characterised in that it has the following features:

(a) one side wall of the container carries a stopper protruding into the inside of the container, the stopper having a suitable shape and size for sealing the inside end of the pipe;

(b) the stopper is arranged at the container wall in such a way that the inside end of the pipe encompasses the stopper sealingly when the roof surfaces is folded in.

10. Container according to claim 1, characterised in that nominal bending lines are designed as open channels.

11. Container according to claim 10, characterised in that nominal bending lines, which are arranged at the edge of inclined surfaces turned towards the axis, have the shape of channels open to the outside.

12. Container according to claim 1, characterised in that external nominal bending lines have at least one surface strip extending in their longitudinal direction which is narrow compared with the diameter of the container, the surface strip forming a prominent necking of the container.

* * * * *